US005692557A

United States Patent [19]

Gillet et al.

[11] Patent Number: 5,692,557

[45] Date of Patent: Dec. 2, 1997

[54] U-TUBE HEAT EXCHANGER, EQUIPPED WITH A TUBE ANTIVIBRATION STABILIZING SYSTEM AND A HOLD-DOWN SYSTEM

[75] Inventors: Nicolas Gillet, Rueil-Malmaison; Christian Valadon, Paris; Jean-Pierre Roinjard, Fontaines; Joseph Chabrerie, Paris; Sok Kang, Pontault Combault, all of France

[73] Assignee: Framatome, Paris, France

[21] Appl. No.: 611,132

[22] Filed: Mar. 5, 1996

[30] Foreign Application Priority Data

Mar. 9, 1995 [FR] France ..... 95 02745

[51] Int. Cl.[6] ..... F28F 9/00; F22B 37/24

[52] U.S. Cl. ..... 165/69; 165/162; 122/510

[58] Field of Search ..... 165/69, 162; 122/510

[56] References Cited

U.S. PATENT DOCUMENTS

| | | | |
|---|---|---|---|
| 3,199,582 | 8/1965 | Vogt et al. | 165/69 |
| 3,212,567 | 10/1965 | Romanos | 165/69 |
| 4,202,085 | 5/1980 | Vollmer | 29/890.043 |
| 4,319,725 | 3/1982 | Meuschke et al. | 29/890.043 X |
| 5,005,637 | 4/1991 | Gentry | 165/69 |
| 5,042,433 | 8/1991 | Monnier | 122/510 |
| 5,127,469 | 7/1992 | Boula | 165/69 |
| 5,514,250 | 5/1996 | Boula et al. | 165/69 |

*Primary Examiner*—Leonard R. Leo

*Attorney, Agent, or Firm*—Pollock, Vande Sande & Priddy

[57] ABSTRACT

A heat exchanger, in particular for a nuclear reactor steam generator, comprising a U-tube bundle and a stabilizing system composed of anti-vibration bars inserted between the tubes of the bundle in the upper tube U-bend region. The anti-vibration bars have portions that protrude from the tube bend region, and the stabilizing system comprises elements which connect the aligned portions of the ends of the anti-vibration bars and are composed of a comb with slots designed to receive the ends of the anti-vibration bars, and a comb cover attached with fastening means. All the connecting elements are attached to supports that are joined to the bundle wrapper, while allowing limited movement of the set of anti-vibration bars and connecting elements.

16 Claims, 6 Drawing Sheets

U-TUBE HEAT EXCHANGER, EQUIPPED WITH A TUBE ANTIVIBRATION STABILIZING SYSTEM AND A HOLD-DOWN SYSTEM

FIELD OF THE INVENTION

The invention concerns a heat exchanger comprising a U-tube bundle and anti-vibration bars between the tube U-bends. The invention applies in particular to steam generators in a nuclear pressurized water reactor.

BACKGROUND OF THE INVENTION

Steam generators of nuclear pressurized water reactors have U-tubes with two parallel straight legs whose ends are expanded into a tube plate.

As the ends of the tubes are inserted into apertures in the tube plate, that are regularly distributed in a rectangular or triangular pattern, the bundle tubes are therefore held in a regular arrangement in which the straight legs are all parallel to each other and the tubes are placed in flat layers parallel to each other, in which the curved portions of the tubes have bend radii that decrease from the outside to the inside of the layer.

The curved portions of the tubes of each of the tube layers have different bend radii and are placed side by side so as to form an approximately hemispherical structure called the tube bend region, at the top of the steam generator bundle.

During steam generator operation, pressurized water at high temperature flows through the bundle tubes and feedwater is brought into contact with the outer exchange surface of the tubes, along which it flows vertically, heating up and then vaporizing, and emerges in the form of steam at the upper part of the steam generator.

The flow of fluids in contact with the tubes can cause vibrations which may lead to tube deterioration if the tubes are not efficiently held.

The straight portions of the tubes are fitted into tube spacer supports equally spaced from each other at distances that depend on the height of the bundle. These straight portions are therefore effectively held by rigid parts. The curved portions of the bundle tubes composing the tube bend region also need to be held, and anti-vibration bars are generally used for this purpose; each of these bars is set between two layers of adjacent bundle tubes and placed in approximately radial directions from the tube bend region. These anti-vibration bars, as described for example in U.S. Pat. No. 3,007,679, are usually joined together in pairs from their ends to inside the tube bend region, and placed in an angular arrangement to form V-shaped structures.

The outer ends of the anti-vibration bars protrude from the tubes composing the outer layer of the tube bend region, and are linked together by connecting devices that ensure that the anti-vibration bars are held in place.

Various means of joining the outer ends of the anti-vibration bars have been proposed, using attachments placed above the upper surface of the tube bend region.

It was first proposed, for example in U.S. Pat. No. 3,007,679, that the ends of the anti-vibration bars be welded onto curved elements called hoops placed in the meridional plane through the tube bend region.

Securing the anti-vibration bars using welds that have to be made in the vicinity of the bundle tubes may damage the tubes.

Mechanical connecting devices were therefore proposed, that enabled connecting the outer ends of the anti-vibration bars to attachment fittings, such as retaining rings placed above the outer surface of the tube bend region.

FR-A-2 644 281, assigned to the present applicant, provides for the installation of approximately semi-circular retaining members to which brackets are secured; these brackets are perpendicular to the retainer members and placed opposite each anti-vibration bar end. A mechanical system enables connecting the ends of each anti-vibration bar to the corresponding bracket.

Mechanical connecting devices have also been proposed, allowing the outer ends of the anti-vibration bars to be joined by mechanical connections placed so as to group successive sets of anti-vibration bar ends together.

In FR-A-2 644 965, also assigned to the present applicant, a stabilizing system was proposed comprising connections between the outer ends of anti-vibration bars placed in assemblies of at least two bars, in which the bars are aligned and have aligned through apertures, one of which is tapped. The anti-vibration bar connecting devices comprise a pin that is inserted into the aligned apertures of the set of anti-vibration bars and into the bores of spacers which are each disposed between two successive anti-vibration bars. The pin, which is threaded at one end, is screwed into the tapped aperture of an anti-vibration bar situated at the end of the layer. The pin is also connected to an anti-rotation device that can be welded to a spacer. This type of system has advantages over previously known mechanical systems, but requires using pins whose length depends on the number of bars and on the length of the layer of anti-vibration bars whose ends are connected together. In some cases, a very long pin has to be used, which can have drawbacks with respect to installation conditions and the mechanical strength of the pin.

FR-A-93/12 514, also assigned to the present applicant, provides for an anti-vibration retaining system comprising connecting devices between the outer ends of the anti-vibration bars placed in sets of at least two, in which the bars are aligned and comprise aligned apertures. The connecting devices between the ends of the anti-vibration bars comprise a screw whose head is designed to rest on a first anti-vibration bar and whose threaded shank is screwed into a spacer. The spacer is secured into either a second spacer, or into a tapped attachment element via a threaded part. The threaded parts of the screw and the spacer pass through the anti-vibration bars via the aligned apertures.

The disadvantage of the above-mentioned anti-vibration systems is that they involve assembling a large number of mechanical parts, which lengthens the installation time, and that certain parts may be dispersed during assembly, operation, or maintenance.

All anti-vibration stabilizing systems comprising anti-vibration bars require a hold-down device to ensure they are held within the tube bend region.

In the previously mentioned U.S. Pat. No. 3,007,679, hold-down locking clips are used, formed by U-shaped parts welded onto frame members, enclosing several tubes of the tube bundle inside the U so as to connect the hoops and the anti-vibration bars to the tubes.

Locking clips are also used in FR 2-A-644 281, FR-A-2 664 965, and FR 93/12 514, and are secured mechanically to avoid welds.

However, locking clips have the disadvantage of holding the anti-vibration device by applying the hold-down load to certain of the bundle tubes. As the tubes are sensitive elements in steam generator operation, elements other than the tubes were sought to absorb the hold-down load.

In FR-A-91-14655, assigned to the present applicant, an attachment device is proposed for the anti-vibration bars to prevent their ejection outside the bundle in an operating steam generator: the device comprises a long structure attached to the tube support plate of the steam generator that is closest to the curved portion of the tubes composing the tube bend region. The elongated structure, usually in the form of a rail, is secured to the upper face of the support plate, perpendicularly to the layers of the tubes, inside the central free space composing the steam generator tube lanes. The elongated attachment structure has, opposite each of the spaces between two pairs of adjacent tube layers, at least one slot into which the inner portion of the anti-vibration bar can be inserted.

This hold-down system, while avoiding the drawback cited above of placing the hold-down load on the tubes, requires a fairly long installation time during assembly operations, because the anti-vibration bars have to be inserted into a large number of slots, and it does not ensure that the anti-vibration device is securely held in position.

SUMMARY OF THE INVENTION

It is an object of the invention to propose a heat exchanger comprising a U-tube bundle consisting of two straight legs and a curved portion between the two straight legs, the bundle tubes being placed in a regular arrangement with all the straight legs parallel; tubes placed in parallel flat layers; a bundle wrapper surrounding the tube bundle; a plurality of anti-vibration bars placed between the curved portions of the adjacent layers of tubes so that their ends extend beyond the bundle; connecting devices between the outer ends of the anti-vibration bars; and a hold-down system that does not place the hold-down load on the bundle tubes, that is simpler to assemble than other known devices, but ensures that the anti-vibration bars and their attachments are securely held in position.

For this purpose, the set of above-mentioned connecting devices is joined to at least one support connected to the bundle wrapper so as to form the anti-vibration bar hold-down system, allowing limited movement of the set of anti-vibration bars and of the connecting devices in a direction parallel to the straight legs of the tubes.

Another object of the invention is to propose a heat exchanger comprising a U-tube bundle with two straight legs and a curved portion between the two straight legs, the bundle tubes being placed in a regular arrangement with all the straight legs parallel; tubes placed in parallel flat layers; a bundle wrapper surrounding the tube bundle; a plurality of anti-vibration bars placed between the curved portions of the adjacent layers of tubes so that one end extends beyond the bundle; and connecting devices between the outer ends of the anti-vibration bars linking them together into several sets of at least two bars, in which the bars are aligned, and designed so as to limit the number of connection parts and facilitate their assembly.

For this purpose, the connecting devices comprise, for each of the sets of aligned anti-vibration bars:

- a comb with slots designed to receive the ends of the anti-vibration bars,
- a comb cover designed to close the spaces made by the slots, and
- a system to fasten the cover onto the comb.

BRIEF DESCRIPTION OF THE DRAWINGS

For a clear understanding of the invention, we shall now describe, by way of example, and with reference to the appended drawings, a nuclear pressurized water reactor steam generator and the stabilizing system of the invention associated with this steam generator.

DESCRIPTION OF PREFERRED EMBODIMENT

Figure 1:
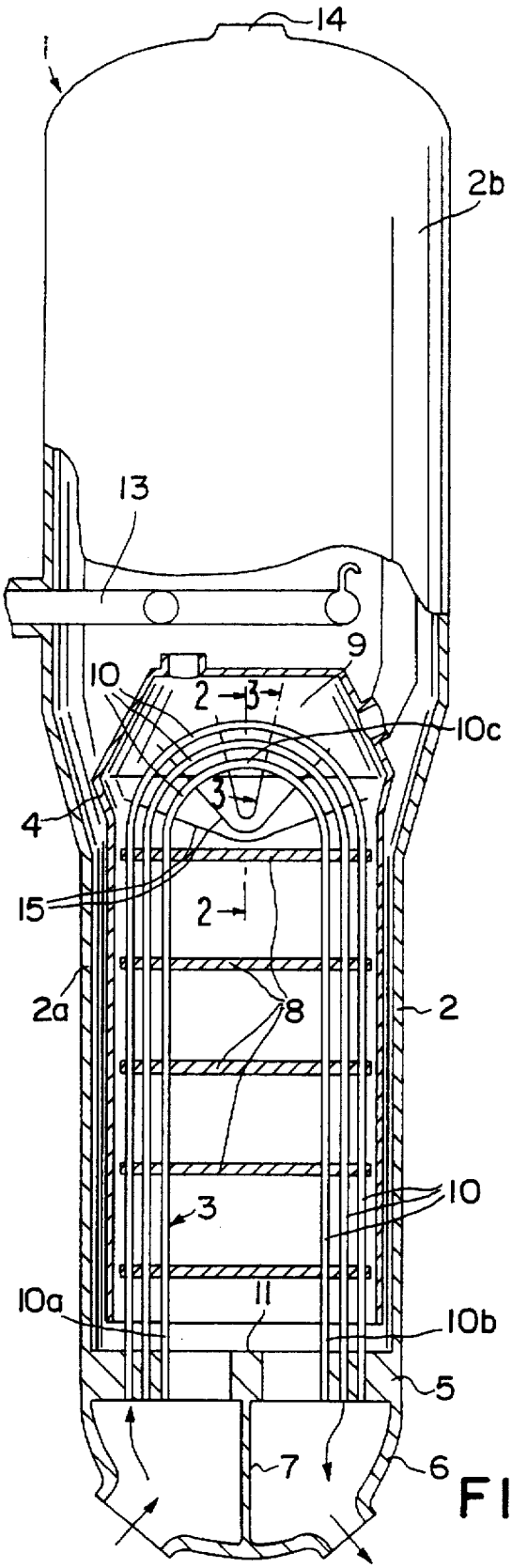
FIG. 1 is an elevation view with a partial section through the vertical plane of a nuclear pressurized water reactor steam generator.

FIG. 1 shows the steam generator 1 of a pressurized water reactor.

The steam generator has an outer shell (2) composed of a lower cylindrical part (2*a*), in which the steam generator tube bundle (3) is located, inside a bundle wrapper (4). The upper part (2*b*) of the steam generator shell (2) has a diameter greater than the diameter of the lower part (2*a*), and contains moisture separators and dryers for the steam produced in contact with the bundle (3).

The lower end (2*a*) of the shell (2) is connected to a very thick tube plate (5) which is traversed by apertures into which the tubes of the tube bundle (3) are inserted and secured by welding and expansion (mechanical or hydraulic, for example). At the other end of the lower part (2*a*) of the shell (2), a hemispherical shell (6) is attached to the tube plate, dividing the steam generator channel head into two parts separated by a partition (7).

Each of the two parts of the channel head is connected by a nozzle to the primary coolant system of the reactor, in which there is a flow of pressurized cooling water from the reactor core.

The bundle (3) is composed of tubes (10) bent into a U shape. Each of the tubes (10) has two straight legs (10*a*) and (10*b*), and an approximately semi-circular curved portion (10*c*) between the straight legs (10*a*) and (10*b*).

The ends of the legs (10*a*) and (10*b*) are inserted, and expanded into apertures in the tube plate (5), on either side of the partition (7).

The straight legs (10*a*) and (10*b*) of the bundle tubes (10) are also inserted into apertures in tube support plates (8) at intervals depending on the height of the bundle. The set of apertures in each of the support plates reproduces the set of apertures in the tube plate so that the legs (10*a*) and (10*b*) are held in a parallel arrangement.

In addition, the set of apertures of the tube plate (5) and the tube support plates (8) have rectilinear rows into which the straight tube legs (10) are inserted; the curved portions (10*c*) of the legs have bend radii that decrease from the outermost part of the bundle to the innermost part of the bundle. The bundle tubes thus form successive layers (12), which can be seen in particular in FIG. 2. In each layer, the bend radii of the curved portions (10*c*) or tube U-bends decrease from the outermost tube to the innermost tube, i.e., from top to bottom. The bend radius of the outermost tube of the layer with the maximum bend radius decreases from the central innermost part of the bundle to the outermost part of the bundle.

As a result, the tube bend region (9), composed of the juxtaposed U-bends (10*c*) of the tubes (10), has an approximately hemispherical shape. The sets of apertures for insertion of the tubes in the tube plate (5) and the tube support plates (8) are interrupted in the central portion of the plates in a diametral direction, so as to define a free space or tube lane (11) in the central portion of the bundle between the legs of the tubes with the shortest bend radii under the small U-bends, which are aligned in the diametral direction of the tube lane (11).

The steam generator (1) has a feedwater ring (13) disposed over the upper part of the bundle wrapper (4), in which the tube bend region (9) is located.

When the steam generator is in service, pressurized reactor coolant water flows into one of the compartments of the channel head so as to be distributed inside the tube legs (10*a*) of the bundle opening into this inlet compartment. The pressurized water flows through the tubes, then flows back into the second compartment of the channel head through the second legs (10*b*) of the tubes (10). The water recovered at the tube bundle outlet is recirculated to the reactor vessel via a pipe to the primary coolant system.

The feedwater introduced into the steam generator shell (2) by the feedwater ring (13) flows downwards in the annular space left between the tube bundle wrapper (4) and the outer shell (2) of the steam generator, then flows inside the tube bundle wrapper (4) and comes into contact with the tubes (10) above the upper face of the tube plate (5). The feedwater flows upwards inside the tube bundle, in contact with the tubes, heats and then vaporizes by heat exchange with the pressurized water flowing inside the tubes. The steam formed through contact with the bundle tubes is sent into the upper part (2*b*) of the steam generator to be dried, then is removed via the upper end (14) of the steam generator.

The bundle tubes inside each of the flat layers of tubes (12) are equally spaced from each other and the layers are also placed at equal distances from each other. The steam generator feedwater can thus circulate in contact with the entire outer surface of the tubes.

The water flowing at high speed in contact with the surface of the tubes generates vibrations in the tubes (10), whose straight legs are securely held by the tube support plates (8).

To ensure that the U-bends (10*c*) of the tubes are securely held inside the tube bend region, anti-vibration bars are disposed in each of the free spaces between two adjacent layers (12), so that the legs of the anti-vibration bars are placed in radial directions and that two successive legs conforming to the contour of the U-bends (10*c*) form an approximately constant angle.

Three V-shaped anti-vibration bars, with their total of six legs placed at approximately constant angular spacings, are usually placed between two adjacent layers (12) of the bundle.

The outer ends (15*b*) of the anti-vibration bar legs extend beyond the outermost surface of the tube bend region and enable the anti-vibration bars to be attached.

In what follows, the term anti-vibration bar will designate any leg of a V-shaped assembly (15).

Figure 3A:
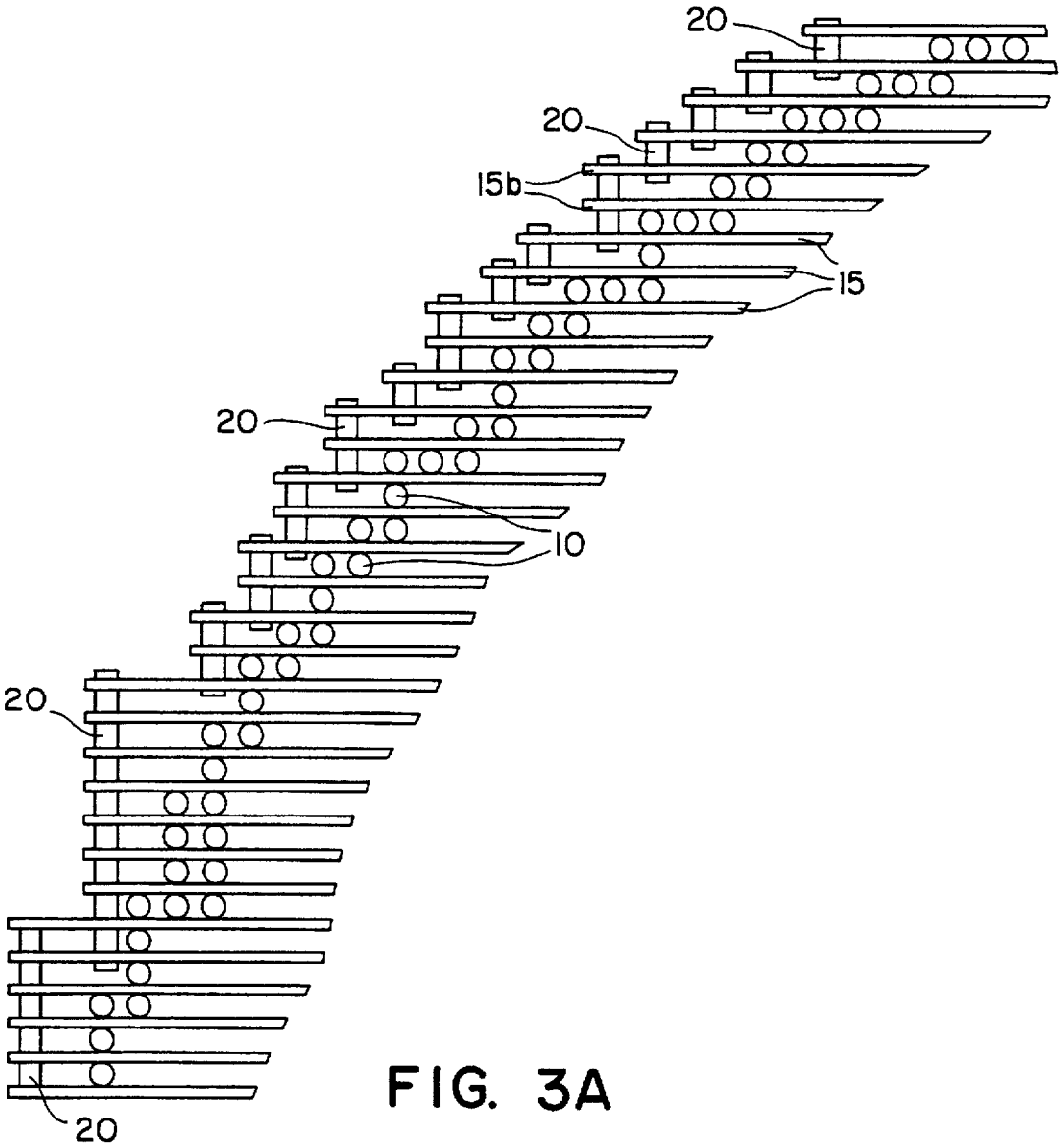
FIG. 3A is a detailed sectional view of FIG. 1, showing the ends of the anti-vibration bars on part of the tube bend region, with a diagram of the connecting parts in the case of a steam generator tube bundle with a square array.
Figure 3B:
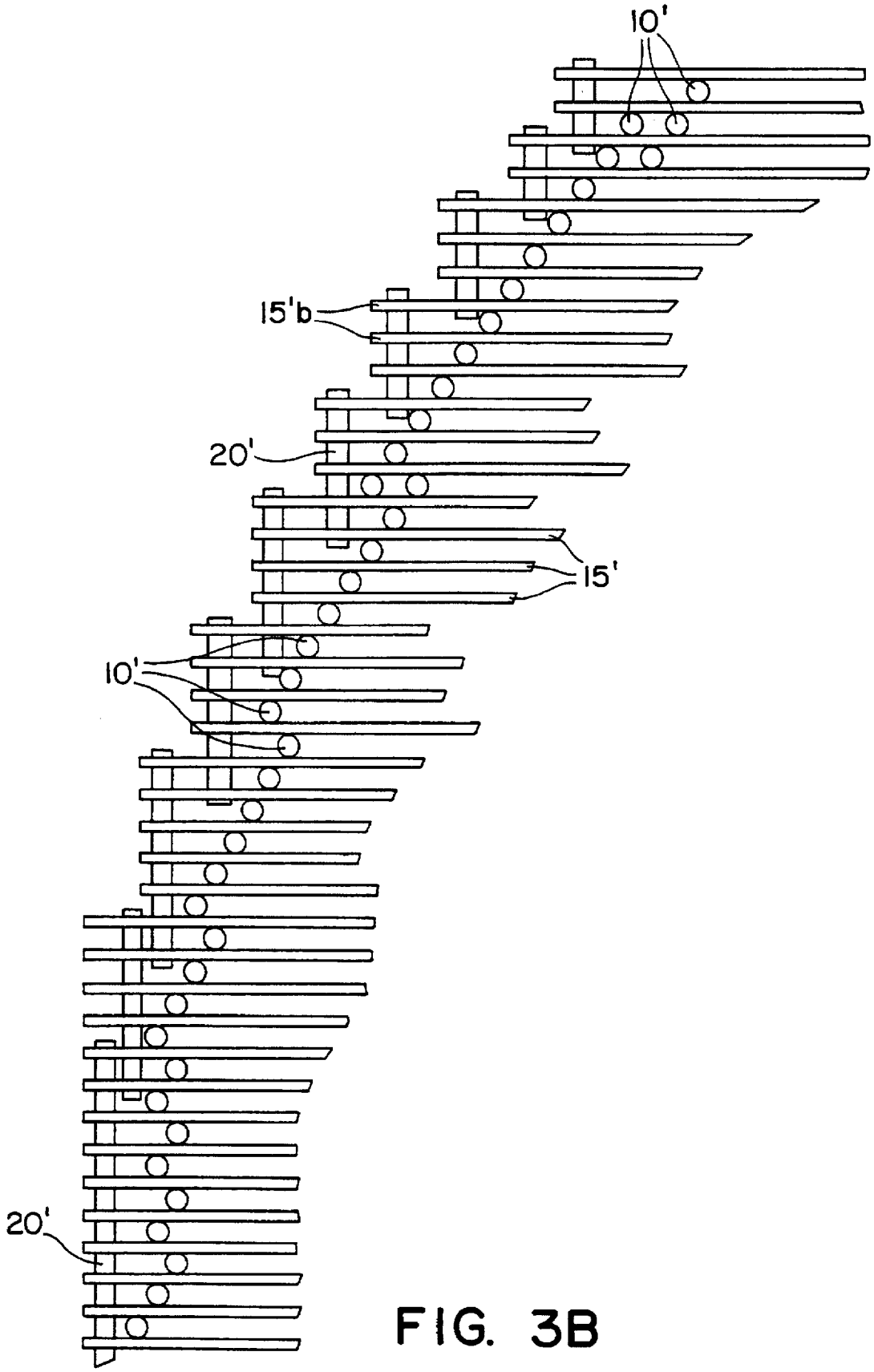
FIG. 3B is a similar view to that of FIG. 3A, in the case of a steam generator tube bundle with a triangular array.

FIGS. 3A and 3B show a sectional view of the upper part of the tube layers, and part of the stabilizing system according to the invention, in the cases of a tube bundle in a square array and a tube bundle in a triangular array, respectively.

The bundle tubes are held in a regular array by the apertures of the tubesheet (5) and the apertures in the tube support plate (8) that have similar arrays of apertures.

The arrangement of the tubes in the case of a triangular array produces in particular in a smaller space between the successive layers of tubes than in the case of a square array.

The device according to the invention can be applied both to the case of a triangular array of closely-spaced tubes and that of a square array.

FIGS. 3A and 3B show the tubes (10) or (10') of the array of tubes composing the outermost layers of the steam generator tube bend region.

The tubes (10) or (10') form parallel successive layers between which the anti-vibration bars are disposed (15) or (15').

In the part of the steam generator tube bundle that forms the tube bend region, the layers of tubes are composed of the juxtaposed tube U-bends with radii decreasing from the outermost part to the innermost part of the tube bend region.

The ends (15*b*) of the anti-vibration bars (15) extend beyond the tube bend region; these ends are in alignment and thus form alignments of variable length.

The protruding ends (15*b*) of the anti-vibration bars are linked together by connecting devices (20), that enable two or more anti-vibration bars composing a set of aligned bars to be connected.

Similarly, the ends of the anti-vibration bars (15') disposed between the layers of tubes placed in a triangular array, as shown in FIG. 3B, can be linked together by means of connecting devices (20'), that enable the ends of two or more anti-vibration bars to be linked together.

Figures 4, 4A:
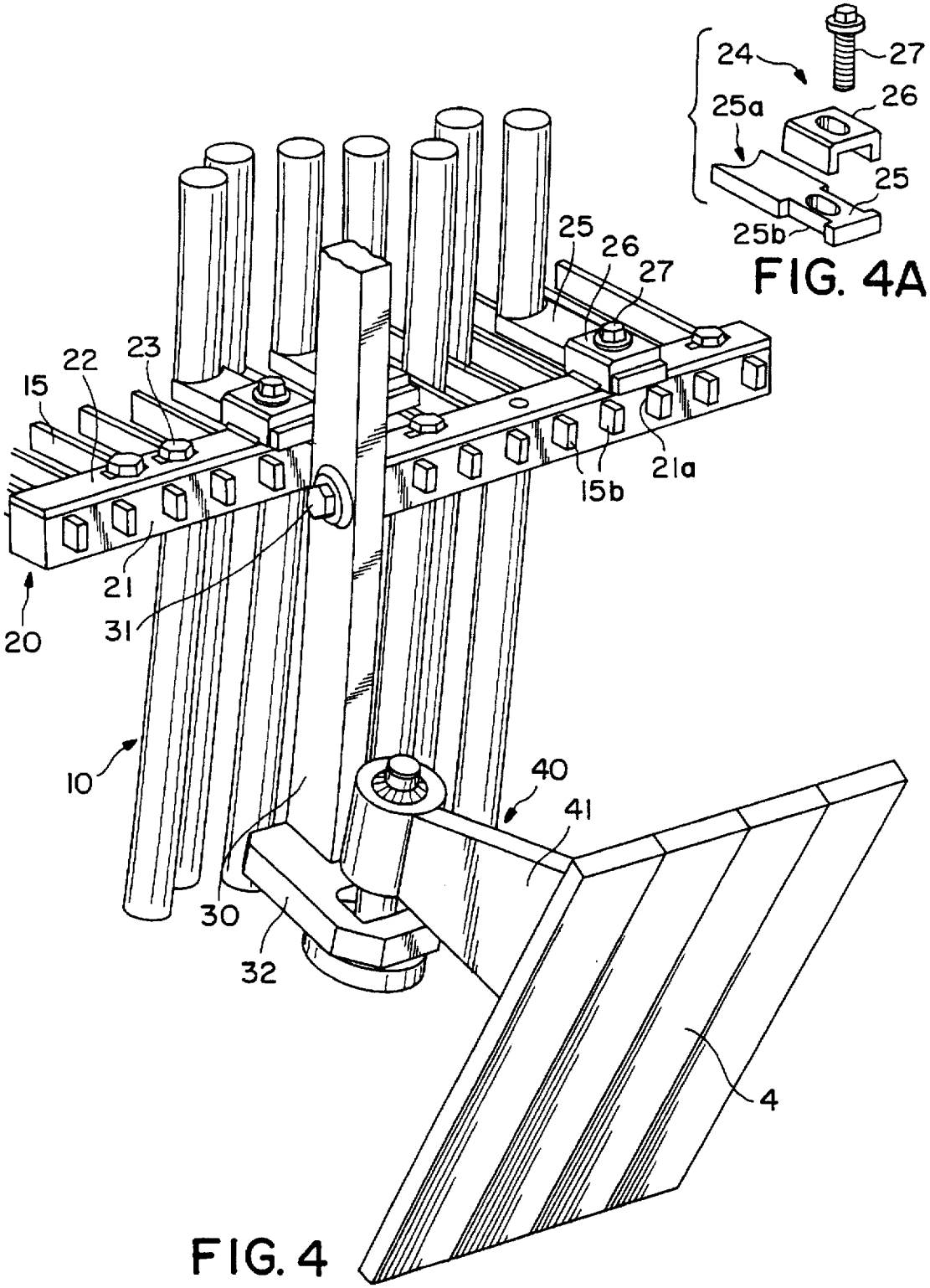
FIG. 4 is a view in perspective of part of the tube supporting system according to the invention, showing the connecting devices and hold-down system.
FIG. 4A is a detailed view of a connecting device stop.

We shall now refer to FIG. 4 in order to describe the stabilizing system connecting devices (20) in accordance with the invention, that enable linking the ends of the anti-vibration bars (15).

Each of the connecting means (20) is composed of an elongated part (21) called a comb, that has slots (21*a*), a closure bar composing its cover (22), (designed to be placed over the slots) (21*a*), and one or several screws (23) to secure the cover to the comb. The slots (21*a*) are designed to receive the ends of the anti-vibration bars (15). A comb (21) has at least two slots to allow linking the anti-vibration bars. The central, and largest comb can, for example, have up to thirty slots.

In order to hold the ends of the anti-vibration bars (15) in the connecting devices (20) more efficiently, anti-vibration bars with slots in their extremities are preferred. The slots of the anti-vibration bars (15) are placed opposite the slots in the comb so that they fit into the bottom of the comb slot, which ensures that the end of the anti-vibration bar is efficiently held in the connecting devices (20). In all cases, the depth and width of the comb slots are designed so that the cross-section of the anti-vibration bar (15) located in the slot (21*a*) of the comb approximately fills the said slot.

The comb (21) has one or more holes tapped between the slots on the face with the slot apertures, designed to receive the connecting screws (23).

The cover (22) is in the shape of an elongated bar and has one or more holes for the connecting screws (23) to go through.

When the anti-vibration bars, whose ends are aligned, are inserted into the slots (21*a*) of the comb (21), the cover is secured above the slots by means of screws (23) which are inserted into the tapped holes of the comb. One or two spot welds between the head of each screw (23) and the cover (22) of the comb (21) ensure that the screws (23) do not rotate.

Finally, some combs have additional holes tapped in the face where the slot apertures are located, as well as in the end face of the combs, as will be explained hereinbelow.

To ensure that the connecting devices (20) and the anti-vibration bars (15) are correctly disposed in relation to the bundle tubes (10), particularly in relation to the tube bend region (9), stops (24), composed of a plate (25), a U-piece (26) and a screw (27), are installed on the combs and are supported by certain tubes (10) situated near the outer part of the tube bend region (9). The stop (24) is shown in detail in FIG. 4A.

The plate (25) is a small elongated plate with a rounded hollowed contour the size of the outer contour of a tube (10). This rounded contour represents the bearing surface on the tube. The stop is slightly wider than the diameter of the tube except for a part where the stop has two recesses (25*b*), and has an oblong hole between the two recesses, placed lengthwise so as to allow adjustment of the position of the stop during assembly.

The U-piece (26) has an inverted U-shaped cross-section. Its length is approximately the same as that of the recesses of the stop (25) and it has an oblong hole and is placed on top of the plate (25) at the level of the recesses.

The screw (27) attaches the stop (25) and the U-piece (26) to the comb (21) through a hole tapped in the comb.

A weld between the U-piece (26) and the comb (21) ensures that the stop plate (25) is held permanently in position. A spot weld between the head of the screw (27) and the U-piece (26) ensures that the screw (27) cannot be loosened.

The connecting means (20) linking the ends of the anti-vibration bars (15) situated in the same meridian plane in the tube bend region are all connected, as two successive connecting means (20) both grip one end (15*b*) of an anti-vibration bar, which is thus inserted into two successive combs (21).

If the combs (21) have a sufficient number of slots, it is preferable to use two anti-vibration bar ends (15) together, inserted into two successive connecting means so as to obtain better overall rigidity.

The ends of anti-vibration bars (15) connected to two successive connecting means then have two slots for insertion into the slots of two successive combs.

When all the connecting means (20) are installed, all the ends (15*b*) of the anti-vibration bars (15) are placed in one or two slots of the combs (21).

In the common case where identical sets of three V-shaped anti-vibration bars (15), with each of the V shapes having a different opening angle, are placed between each tube layer, six sets of anti-vibration bar ends are linked together, the anti-vibration bars being placed approximately along the meridians of the tube bend region in planes perpendicular to the plane of the flat layers (12). The set of connecting means (20) in a given meridian is called an end-connection assembly. Each of these end-connection assemblies is linked to another end-connection assembly situated on the anti-vibration bars with the same opening angle, but is independent of the other four end-connection assemblies.

In order to link all the end-connection assemblies, retaining members (30) are placed parallel to the hemispherical shape of the tube bend region, on the outer part of the tube bend region (9), linking the different end-connection assemblies.

The retaining members (30) are linked to the connecting means (20) as each retainer member is connected to a comb (21) of each end-connection assembly. A retainer member (30) and a comb (21) are connected by a screw (31) that passes through the hole in the retainer member, described above, and screws into the hole tapped in the end face of the comb (21).

Seven retaining members (30) can be used, for example, to maintain all the ends of the anti-vibration bars in one rigid assembly. The various retaining members (30) have different radii, depending on their location above the tube bend region.

Figure 2:
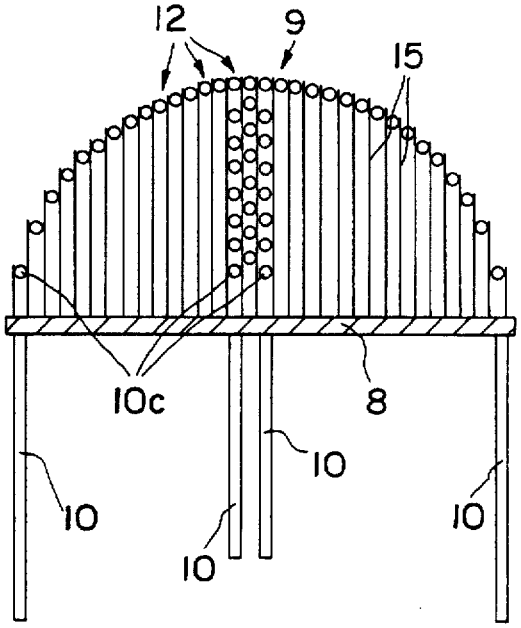
FIG. 2 is a schematic sectional view of the upper part of the tube bend region in a plane perpendicular to that of FIG. 1.

A larger radius central retainer member (30) can be disposed in the plane of FIG. 2, where it is connected to the central comb (21) of each end-connection assembly in the middle of that comb.

Figures 5, 5A:
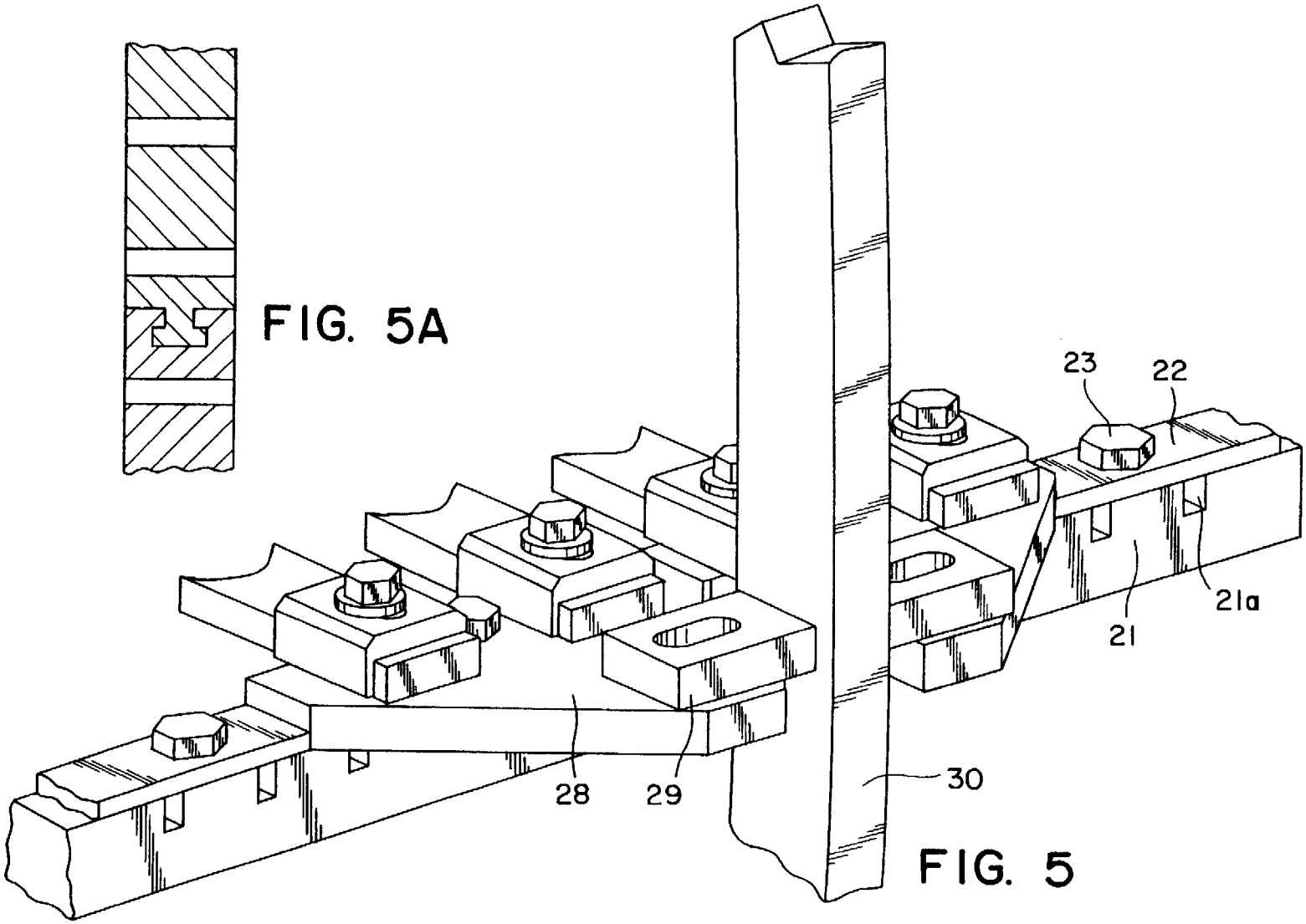
FIG. 5 is a view in perspective of a detail of the tube support system.
FIG. 5A is a sectional view of a detail of the central comb.

FIG. 5 shows the connection between the central comb (21) and the central retainer member (30).

The bundle tubes and the anti-vibration bars can be installed in accordance with the process described in FR-A-2 603 364. In accordance with this process, the tubes are installed in successive layers starting from the largest layer situated in the center, as shown in FIG. 1, and continuing with layers of decreasing size. The anti-vibration bars are progressively disposed between the layers. When half the bundle has been installed, the steam generator is rotated 180° on its axis, in a horizontal position, and the other half of the bundle is installed, once again starting from the largest layer and continuing with layers of decreasing size.

In order to install the central retainer member (30) and the central comb (21), a special central comb is used, composed of two half-combs, which is assembled longitudinally in a dovetail arrangement, as shown in FIG. 5A. Each half-comb is fitted with a support bracket (28) which is screwed onto the comb cover (22).

At the beginning of the assembly of the second half of the tube bundle, the second half-comb is dovetailed into the first half-comb.

The support brackets (28) are installed with the covers of each half-comb and have a tapped hole to receive a mounting bolt. The retainer member is equipped with lugs (29) which are secured with mounting bolts that pass through the lug and screw into the tapped hole of the support bracket (28).

Figure 6:
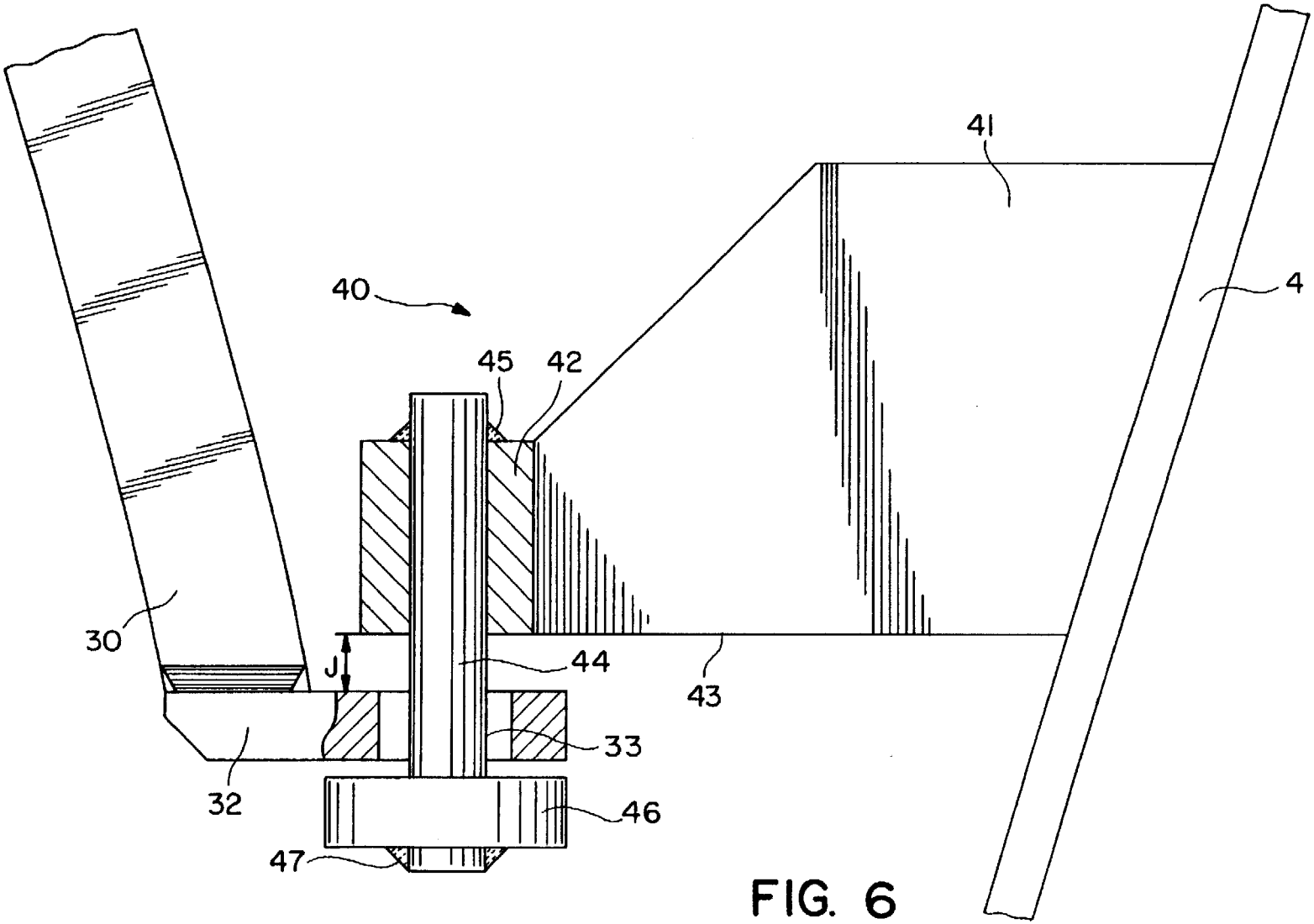
FIG. 6 is a sectional view showing the hold-down system.

FIGS. 4 and 6 show that the anti-vibration device, formed by the anti-vibration bars (15), the end-connection assemblies, and the retaining members (30), is held by a hold-down system.

The entire stabilizing system described previously can shift between the layers of tubes. The intial position of the device when it is installed may change, particularly during steam generator operation. As mentioned in the description of the invention, devices with locking clips retained by the tubes or with a rail on the tube support plate situated near the tube bend region have been used.

In the case of the present invention, supports (40) secured to the tube bundle wrapper (4) and connected to the anti-vibration stabilizing system are used.

The hold-down system which will now described could be used with an anti-vibration stabilizing system than the one described previously, particularly with respect to the anti-vibration bar end connections. The support (40) designed to ensure the hold-down function is composed of a metal bracket (41) attached rigidly by welding to the bundle wrapper (4). The end of the support bracket (41) that is opposite the bundle wrapper (4) is fitted with a bushing (42) designed to receive a pin (44). The pin (44) is set parallel to the axis of the steam generator.

A bracket (32) is rigidly connected by welding to each extremity of the retaining members (30).

The steam generator is most commonly placed with its axis in a vertical position, as shown in FIG. 1. The description below applies to this configuration. If the steam generator were in a horizontal position, the positioning terms would have to be adapted accordingly.

The bracket (32) is approximately flat and placed in a generally horizontal position under the bushing (42) abutting the support bracket (41), whose lower edges are situated on the same horizontal plane (43).

The bracket (32) has an aperture (33) that is slightly larger than the dimensions of the cross-section of the pin (44).

The pin (44), which is longer than the hinge channel (42), is inserted into the bushing (42) so that it protrudes a few millimeters above the bushing (42), and several centimeters below the bushing (42), and passes through the aperture in the bracket (32). It is then welded at the top to the upper face of the bushing (42) by a weld (45).

During assembly, a clearance J is provided between the lower face of the bushing (42), situated on a horizontal plane (43), and the upper face of the bracket (32). This clearance can be ensured by temporarily placing a spacer (not shown) between the above-mentioned faces.

The clearance J, at ambient temperature during assembly, decreases at high temperature. A clearance J should therefore be provided, such that a smaller clearance still subsists under operating conditions.

The device thus formed with the supports ensures that the anti-vibration stabilizing system as a whole will be securely held in a position that is approximately the initial assembly position, and limits both vertical movement of the anti-vibration system towards the upper part of the steam generator, and its tilting.

To leave the system sufficient freedom of movement, the dimensions of the aperture (33) in the bracket (32) are larger than those of the pin (44) and therefore allow limited movement of the supporting device on a horizontal plane.

Finally, to complete the device, a washer (46) is placed at the lower end of the pin (44) and attached to the pin by a weld (47), thus ensuring that the bracket (32) of the retainer member (30) cannot, under any circumstances, free itself from its position on the pin (44).

The supporting device thus described is reproduced at both extremities of the retainer member (30). When seven retaining members (30) are placed as indicated above, it is preferable to install fourteen supports distributed around the circumference of the bundle wrapper (4).

The anti-vibration bar end-connection device could be based on an already existing device and be associated with hold-down supports like that described above.

The hold-down system could be built differently, provided that limited clearance is allowed for movement of all the connecting devices.

The anti-vibration bars can be shaped differently from those described.

The invention can be applied to any steam generator or heat exchanger consisting of a regular array of tubes comprising U-bends between which anti-vibration bars are disposed.

We claim:

1. A heat exchanger comprising a bundle of tubes bent into a U-shape and having two straight legs and a curved portion between said two straight legs, the tubes of the bundle being disposed in a regular arrangement in which the straight legs are all parallel to each other and placed in parallel flat layers, a tube wrapper surrounding the tube bundle, a plurality of anti-vibration bars being set between adjacent layers of tubes at their curved portions so that ends of said vibration bars extend beyond the bundle, connection devices being disposed between outer ends of the anti-vibration bars, wherein each assembly of said connection devices is linked to at least one support attached to the bundle wrapper so as to form a hold-down system for the anti-vibration bars while allowing limited movement of the anti-vibration bars and their connecting devices as a whole in a direction parallel to the straight legs of the tubes.

2. A heat exchanger in accordance with claim 1, wherein the devices connecting the anti-vibration bar ends comprise a first assembly of connecting devices linking the ends of the bars situated approximately in planes perpendicular to planes of the flat layers and composing end-connection assemblies, and a second set of connecting devices linking end-connection assemblies together.

3. A heat exchanger in accordance with claim 2, wherein said second connecting devices have at least one retainer member placed in a plane approximately parallel to the planes of the flat layers.

4. A heat exchanger in accordance with claim 3, wherein at least one retainer member is connected to a support attached to the bundle wrapper.

5. A heat exchanger in accordance with claim 3, wherein the retainer member comprises an approximately horizontal bracket with a window into which a pin is inserted approximately parallel to the straight legs of the tubes and attached to the support, the said support being situated on a same side of the bracket as the set of connecting devices.

6. A heat exchanger in accordance with claim 5, wherein said window has inner dimensions greater than outer dimensions of the pin, so at to allow movement in two dimensions situated in a plane perpendicular to the straight legs of the tubes.

7. A heat exchanger in accordance with claim 5, wherein sufficient clearance is provided under cold conditions between the bracket of the retainer member and a part of the support situated opposite the bracket, so that a clearance still remains under hot conditions during heat exchanger operation.

8. A heat exchanger in accordance with claim 1, wherein the hold-down system allows relative limited movement in all directions between each support attached to the bundle wrapper and the devices connecting the anti-vibration bar ends.

9. A heat exchanger comprising a bundle of tubes bent into a U shape consisting of two straight legs and a curved portion between the two straight legs, the tubes of the bundle being placed in a regular arrangement of parallel flat layers, in which the straight legs are all parallel to each other, a bundle wrapper surrounding the tube bundle, a plurality of anti-vibration bars being disposed between adjacent layers of tubes in their curved portion, so that ends of the bars extend beyond the bundle, and connecting devices connecting outer ends of the anti-vibration bars into several assemblies of at least two bars, in which the bars are aligned, wherein, for each of the assemblies of aligned anti-vibration bars, the connecting devices comprise a comb with slots to receive the ends of the anti-vibration bars, a comb cover, designed to close spaces formed by the slots, and a system to attached the cover to the comb.

10. A heat exchanger in accordance with claim 9, wherein the system to attach the cover to the comb is composed of tapped holes located in the comb and screws entering said tapped holes.

11. A heat exchanger in accordance with claim 9, wherein the anti-vibration bars have slots designed to be positioned opposite corresponding slots in the combs, so as to allow the anti-vibration bars to be held and preventing any relative movement between the anti-vibration bars and the connecting devices.

12. A heat exchanger in accordance with claim 9, wherein the connecting devices situated on a same plane, perpendicular to planes of the flat layers, are linked together via ends of certain anti-vibration bars, which are inserted into two successive combs.

13. A heat exchanger in accordance with claim 9, wherein the combs are positioned in relation to the tube bundle by means of a support device attached to the comb, with a contact surface adapted to an outer profile of certain tubes.

14. A heat exchanger in accordance with claim 13, the support device is composed of a plate held by a comb and a U-piece, and is held together by a threaded fastener.

15. A heat exchanger in accordance with claim 9, wherein end-connection assemblies, composed of successive connecting devices situated in planes perpendicular to planes of the flat layers, are linked together by at least one retainer member parallel to the planes of the flat layers.

16. A heat exchanger in accordance with claim 15, wherein at least one retainer member is connected to a support attached to the bundle wrapper to form a hold-down system for the set of anti-vibration bars.

* * * * *